US007669920B1

(12) United States Patent
Petersen et al.

(10) Patent No.: US 7,669,920 B1
(45) Date of Patent: Mar. 2, 2010

(54) MODULAR LOWER BODY SUPPORT DEVICE

(76) Inventors: Scott J. Petersen, 1325 Abington Way, Mechanicsburg, PA (US) 17050; Carl D. Hipp, 375 Corrine Rd., West Chester, PA (US) 19382

( * ) Notice: Subject to any disclaimer, the term of this patent is extended or adjusted under 35 U.S.C. 154(b) by 0 days.

(21) Appl. No.: 12/287,102

(22) Filed: Oct. 6, 2008

(51) Int. Cl.
*A47C 9/00* (2006.01)
*A47C 16/00* (2006.01)

(52) U.S. Cl. ..... 297/4; 297/423.39

(58) Field of Classification Search ..... 297/4, 297/423.1, 423.11, 423.39, 423.41, 195.11
See application file for complete search history.

(56) References Cited

U.S. PATENT DOCUMENTS

| | | | | |
|---|---|---|---|---|
| 1,296,522 | A | 3/1919 | Holsey | |
| 1,382,883 | A | 6/1921 | Ashbridge | |
| 1,547,166 | A | 7/1925 | Davidson | |
| 2,627,301 | A | 2/1953 | Emmett | |
| 4,377,309 | A | 3/1983 | Mengshoel | |
| 4,772,071 | A | 9/1988 | Richards | |
| 5,073,986 | A | 12/1991 | Farrago | |
| D353,702 | S | 12/1994 | Martinez | |
| 5,537,689 | A | 7/1996 | Dancyger | |
| 5,725,224 | A | 3/1998 | Kerr | |
| 5,865,507 | A | 2/1999 | Earl, Jr. | |
| 5,870,774 | A | 2/1999 | Legenstein | |
| 6,302,413 | B1 | 10/2001 | Comeaux | |
| 6,427,239 | B1 | 8/2002 | Worden | |
| 6,637,034 | B1 | 10/2003 | Worden | |
| 6,824,149 | B1 | 11/2004 | Whit lock | |
| 7,303,516 | B2 | 12/2007 | Petersen | |
| 2003/0127900 | A1 * | 7/2003 | Chen | 297/423.11 |

* cited by examiner

*Primary Examiner*—Milton Nelson, Jr.
(74) *Attorney, Agent, or Firm*—Kollas and Kennedy; James W. Kollas, Esq.

(57) ABSTRACT

A modular a lower body support device is shown herein. An adjustable frame supports the bodyweight of a user such that the knee of the user rests within a knee frame, the shin of the user rests within a bend frame, and the ankle of the user rests within an ankle frame; a knee pad insert is removably attachable to the frame, and a skid plate insert is removably attachable to the knee pad insert; straps and slots are used to fasten the user to the frame; the user may sit on an integrated seat while kneeling, or may wear the device while ambulatory.

19 Claims, 10 Drawing Sheets

MODULAR LOWER BODY SUPPORT DEVICE

CROSS-REFERENCE TO RELATED APPLICATIONS

This independent application is related to application Ser. No. 11/343,427, filed Jan. 30, 2006, now U.S. Pat. No. 7,303,516, dated Dec. 4, 2007.

STATEMENT REGARDING FEDERALLY SPONSORED RESEARCH OR DEVELOPMENT

Not applicable.

BACKGROUND

1. Field of the Invention

This invention is directed toward the field of modular lower body support devices. More particularly, this invention relates to a modular lower body support device providing replaceable knee pad and skid plate inserts.

2. Discussion of Prior Art

Many occupations require workers to assume kneeling positions in order to attend the task for which they are employed. Unfortunately, assuming a kneeling position for an extended period, or repeatedly, causes those in such a position discomfort, cramping, muscle fatigue, or other similar problems.

Many devices have been proposed over the years to alleviate the discomforts associated with working in kneeling positions. For instance, U.S. Pat. No. 1,296,522 to Holsey shows a simple knee pad device. Similarly, U.S. Pat. No. 1,547,166 to Davidison shows a slightly more sophisticated knee pad. However, neither device provides much in the way of actual support or cushioning. That is, even though the knee is elevated above whatever surface on which the knee pad rests, the user's weight still stresses the knee directly.

In U.S. Pat. No. 2,627,301 to Emmett, a knee board is shown. Although this device implements a recognizable pad to cushion the knee, it does not allow much mobility to a standing user. As such, its utility is diminished.

In U.S. Pat. No. 4,377,309 to Mengshoel another knee board device is illustrated. Through a variety of configurations, Mengshoel discloses a more portable device than previously shown. Additionally, the device has provision for a seat element, which takes some stress off the user's knees. However, the user's weight still passes through the user's ankles. Moreover, in the J-shaped ankle configuration the user's leg may separate from the pad, especially when employed in a dynamic occupational setting. Additionally, the O-shaped ankle configuration, the ability of the user to equip the device is impaired. That is, putting one's foot through the O-shaped ankle configuration is difficult.

In U.S. Pat. No. 4,772,071 to Richards, a complicated knee pad device is shown. Said device includes a frame with a knee pad section, a seat section, and a mid-shin floor engaging member. This device is hampered by its obvious complexity. Moreover, it is designed with an integrated knee pad, limiting the user to employing that knee pad exclusively. Additionally, this device is not particularly stable, being prone to side-to-side rolling or pivoting.

In U.S. Pat. No. 5,865,507 to Earl, a kneeler is shown. This kneeler allows a certain amount of the user's weight to pass through the seat incorporated in the frame of the device. However, a user of the device cannot walk around with this device attached to their legs. As such, the user would have to carry such device with them, greatly diminishing its utility.

In U.S. Pat. No. 7,303,516 to Petersen, a lower body support device is shown. Said device allows a user to choose a knee pad and strap it onto a frame through a fastening means. It also features a removable seat for supporting the weight of the user. Despite these advantages, the lower body support device does not provide its own replaceable knee pad insert, which would be easy to install and remove; and, would be certain to fit onto the frame. Moreover, it does not provide a replaceable skid plate insert for use under the aforesaid replaceable knee pad insert.

As such, there is a void in the prior art in the field of lower body support devices. The prior art lacks a modular device which provides an easily replaceable knee pad insert, together with a replaceable skid plate insert, which may be integrated into a suitably comfortable and sturdy lower body support frame. The present invention fills this void.

BRIEF SUMMARY OF THE INVENTION

In accordance with the present invention, a modular lower body support device with replaceable knee pad insert and replaceable skid plate insert is shown herein. The lower leg of the user is positioned such that the knee of the user rests within the area defined by a knee frame, the shin of the user rests within the area defined by a bend frame, and the ankle of the user rests in the region of an ankle frame. A knee pad insert adjoining means on the knee frame allows for the securing of a knee pad insert, which is designed to attach onto the knee pad insert adjoining means. A seating means, which may be a seat insert, is secured to the top of the ankle frame. The user wears one leg support device on each leg.

While resting on a surface, the bottom of the knee frame and the bottom of the ankle frame, and possibly the bottom of the replaceable skid plate insert, contact said surface. Preferably, the buttocks of the user rest on the seating means, which transfers a significant portion of the weight of the user to the surface via the frames. The ankle frame, bend frame, and knee frame greatly limit the possibility of side-to-side motion. Additionally, the user may stand and walk while employing the modular lower body support device.

Furthermore, the overall length of the device may be adjusted. Such adjustment allows increased user comfort.

OBJECTS AND ADVANTAGES

Accordingly, the objects and advantages of the invention are:

A) to provide a modular lower body support device which accepts a knee pad insert to fit within the knee frame of the device;

B) to provide a modular lower body support device which may be worn and employed by a user while kneeling, standing, or walking;

C) to provide a modular lower body support device which transfers a significant portion of the weight of the user through the device and away from the knee and joints of the user;

D) to provide a modular lower body support device which allows improved stability while employed in a kneeling position; and E) to provide a modular lower body support device which may be adjusted in regard to length to more comfortably fit a user.

Further objects and advantages are to provide a modular lower body support device with a replaceable knee pad insert which may be easily replaced when said knee pad insert is no longer useful in the discretion of the user. Still further objects and advantages will become apparent from consideration of the ensuing description and drawings.

REFERENCE NUMERALS IN DRAWINGS

Figure 1:
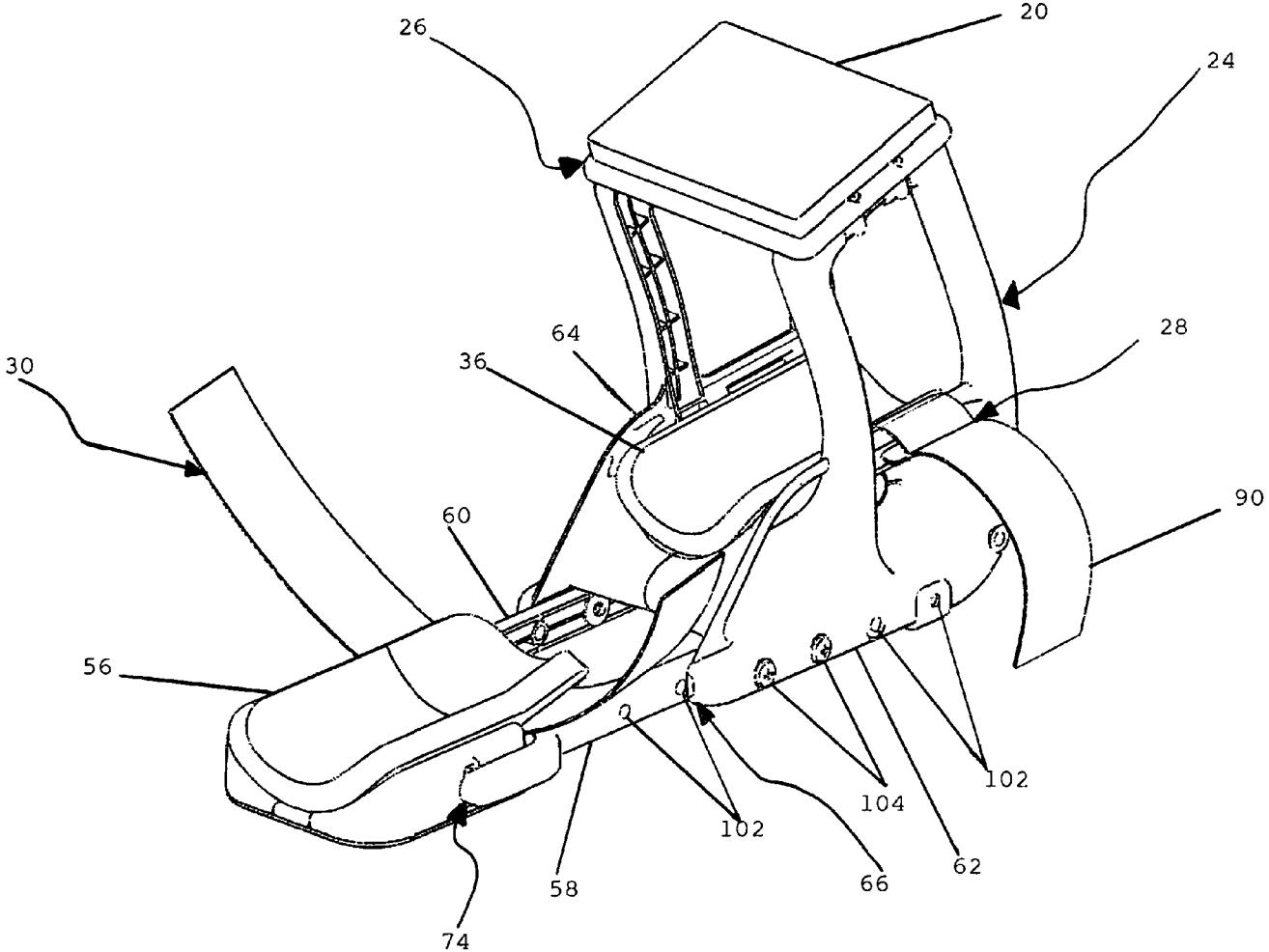
FIG. 1 is an Isometric View of the Preferred Embodiment of the Modular Lower Body Support Device.

Knee frame
12 Bend frame
14 Ankle frame
16 Seat
20 Cushioning seat pad
22 Hinge
24 Framing means
26 Seating means
28 Knee fastening means
30 Ankle fastening means
32 Leg fastening means
36 Cushioning shin pad
40 First frontal bracket
42 Second frontal bracket
44 First frontal tab
46 Second frontal tab
48 Rear double bracket
50 First rear tab
52 Second rear tab
56 Cushioning knee pad
58 First bend frame side
60 Second bend frame side
62 First ankle frame side
64 Second ankle frame side
66 Frame lengthening means
72 Knee pad insert
74 Knee pad insert adjoining means
76 Skid plate insert
78 First knee pad insert slot
80 Second knee pad insert slot
82 First knee pad strap
84 Second knee pad strap
86 First ankle frame slot
88 Second ankle frame slot
90 First ankle frame strap
94 First key slot
96 Second key slot
98 First key
100 Second key
102 Threaded hole
104 Threaded fastener
106 Securing fastener
108 Exposed threads
110 Third ankle frame slot
112 Fourth ankle frame slot

DETAILED DESCRIPTION OF INVENTION

In its most simple configuration the modular lower body support device comprises six basic elements. First, there is a framing means 24 to support the leg of the user. Second there is a seating means 26 providing a region on which the user may sit. Once seated, a substantial amount of the user's body weight is transferred through the device, away from the user's leg, and onto the surface upon which the device rests. Third, there is a knee pad insert adjoining means 74 on the framing means 24 allowing for the securing of a knee pad insert 72. The fourth basic element is the aforesaid knee pad insert 72, which may be fitted with a skid plate insert 76. Fifth, is the leg fastening means 32, which preferably comprises a knee fastening means 28 and an ankle fastening means 30, for securing the user to the device. Sixth, is the frame lengthening means 66, which allows the user to adjust the overall length of the device for increased user comfort.

In the preferred embodiment of the invention, the framing means 24 is divided into three parts. As shown in FIG. 1, these parts are the knee frame 10, the bend frame 12, and the ankle frame 14.

Knee frame 10 receives the knee of the user. Knee frame 10 is designed to accommodate both the knee of the user as well as a knee pad insert 72. The knee pad insert 72 attaches to the knee frame 10 via the knee pad insert adjoining means 74. Additionally, skid plate insert 76 may be attached to the bottom of the knee pad insert 72. This is discussed in detail below.

Bend frame 12 receives the shin of the user. As may be seen in FIG. 1, bend frame 12 connects knee frame 10 to ankle frame 14.

Ankle frame 14 receives the ankle of the user. Ankle frame 14 is designed to receive the bend frame 12. The upper portion of ankle frame 14 connects to a seating means 26, preferably a seat 16, on which a user may sit. In the preferred embodiment, seat 16 may be opened via a hinge 22, allowing easy access to the user for positioning the user's shin onto bend frame 12 and the user's ankle onto the ankle frame 14.

As initially indicated above, in the preferred embodiment of the device, a frame lengthening means 66 is used to adjust the overall length of the device. Preferably, the frame lengthening means 66 is adjusted as follows.

A first ankle frame side 62 and a second ankle frame side 64, as well as a first bend frame side 58 and a second bend frame side 60, are fitted with a plurality of threaded holes 102 for adjusting the overall length of the device. That is, the user may adjust the overall length of the device by aligning the threaded holes 102 in the bend frame sides, 58 and 60, with the threaded holes 102 in the ankle frame sides, 62 and 64, respectively; and, thereafter threading a threaded fastener 104 through the aligned threaded holes 102 on each respective side, first and second.

Figure 2:
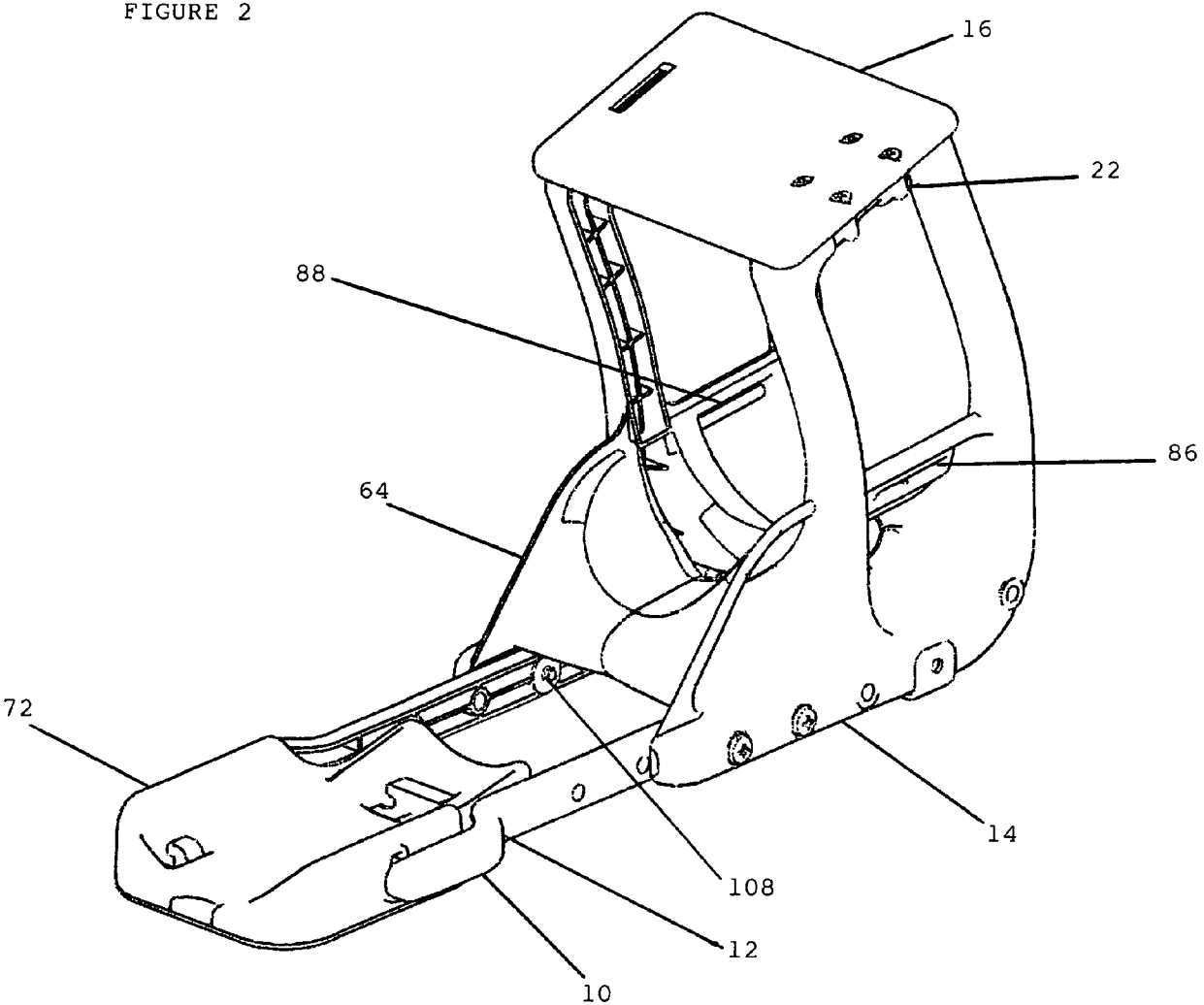
FIG. 2 is an Isometric View of the Modular Lower Body Support Device.

Additionally, once the threaded fasteners 104 are in place, it is preferable to tighten a securing fastener 106 to the exposed threads 108 of the threaded fastener 104 as shown in FIG. 2. Although one threaded fastener 104 per side is sufficient, preferably two threaded fasteners 104 may be used per side.

As stated earlier, leg fastening means 32 preferably comprises knee fastening means 28 and ankle fastening means 30. Knee fastening means 28 and ankle fastening means 30 for securing the user to the device are implemented at the knee pad insert 72 and the ankle frame 14, respectively. Knee fastening means 28 and leg fastening means 30 are discussed in turn below.

For knee fastening means 28, a first knee pad insert slot 78 on the side of knee pad insert 72 accepts a first knee pad strap 82, which is placed through said first knee pad insert slot 78, folded over and stitched, leaving a length of first knee pad strap 82 available for use for fastening. Similarly, a second knee pad insert slot 80 on the other side of knee pad insert 72 accepts a second knee pad strap 84, which is placed through said second knee pad insert slot 80, folded over and stitched, leaving a length of second knee pad strap 84 available for use for fastening with the strap length from first knee pad strap 82. That is, after the user positions the user's knee on the knee pad insert 72, which itself is attached to knee frame 10 via the knee pad insert adjoining means 74, then the user connects the lengths of first knee pad strap 82 and second knee pad strap 84, and tightens as the user sees fit. For illustration, see FIGS. 3B and 6.

For ankle fastening means 30, a first ankle frame slot 86 on the side of ankle frame 14 accepts a first ankle frame strap 90, which is placed through said first ankle frame slot 86, folded over and stitched, leaving a length of first ankle frame strap 90. First ankle frame strap 90 is then fed through a second ankle frame slot 88, folded over and attached to itself, preferably with hook and loop fasteners.

In the preferred embodiment of the invention, knee pad insert 72 is attached to knee pad insert adjoining means 74. As can be seen in FIG. 4, knee pad insert 72 has a first key slot 94 and a second key slot 96. Correspondingly, as can be seen on FIG. 3, knee pad insert adjoining means 74 has a first key 98 and a second key 100.

Figure 3:
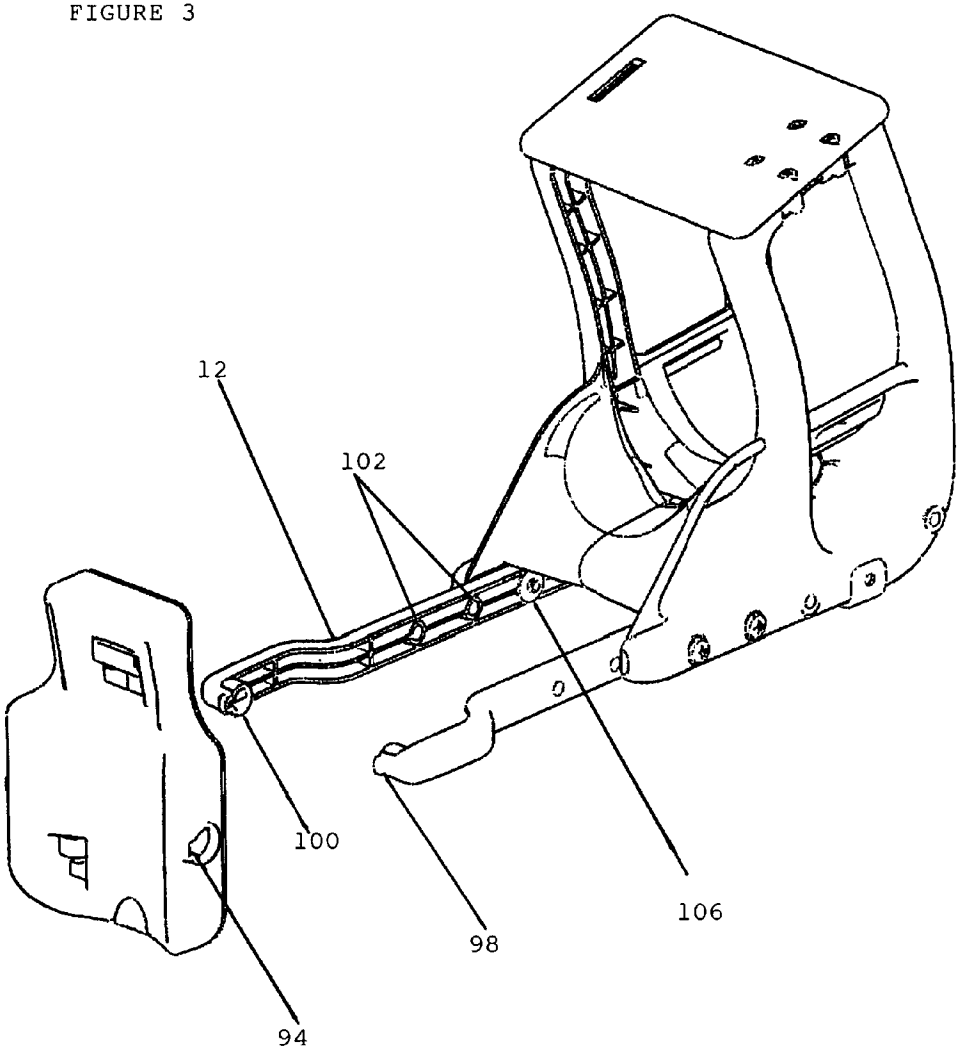
FIG. 3 is an Isometric View of the Modular Lower Body Support Device with Knee Pad Insert Disconnected.
Figure 3A:
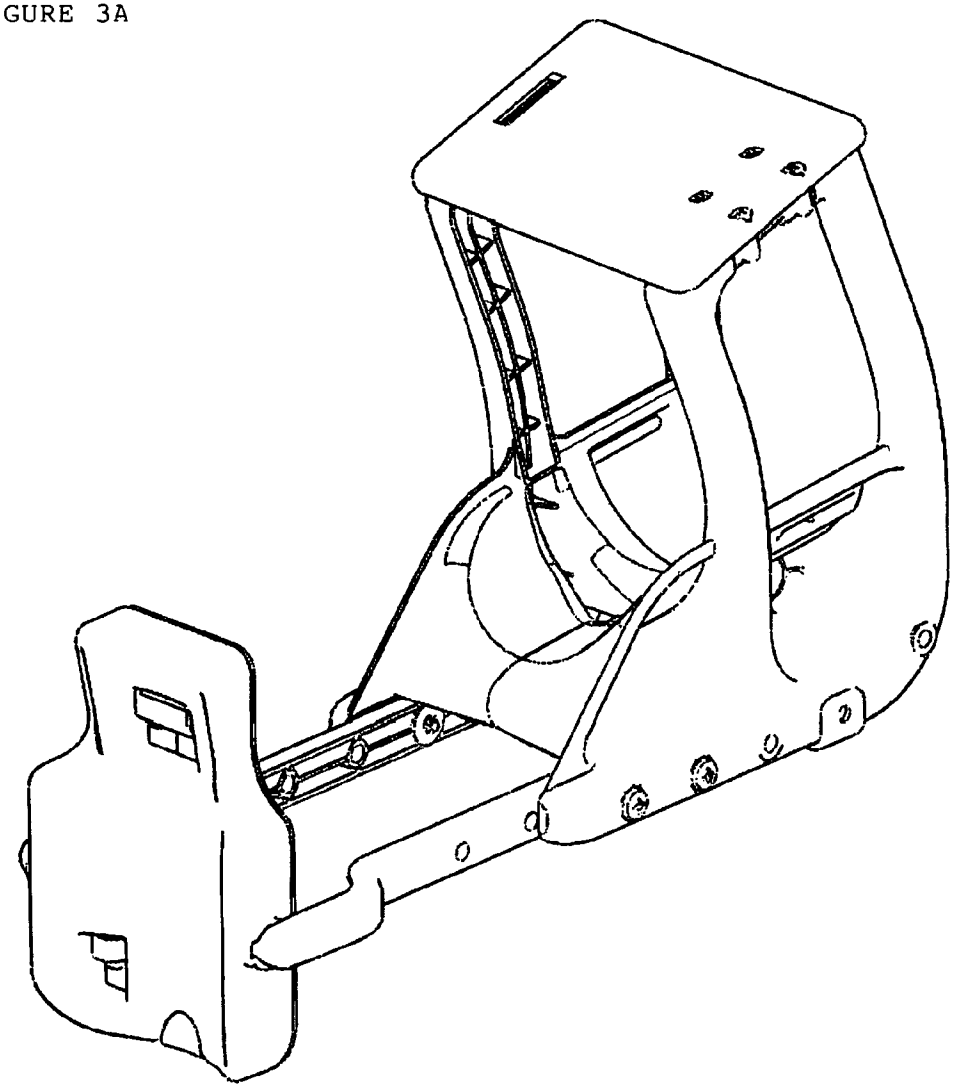
FIG. 3A is an Isometric View of the Modular Lower Body Support Device with Knee Pad Insert Connected in Unlocked Position.
Figure 3B:
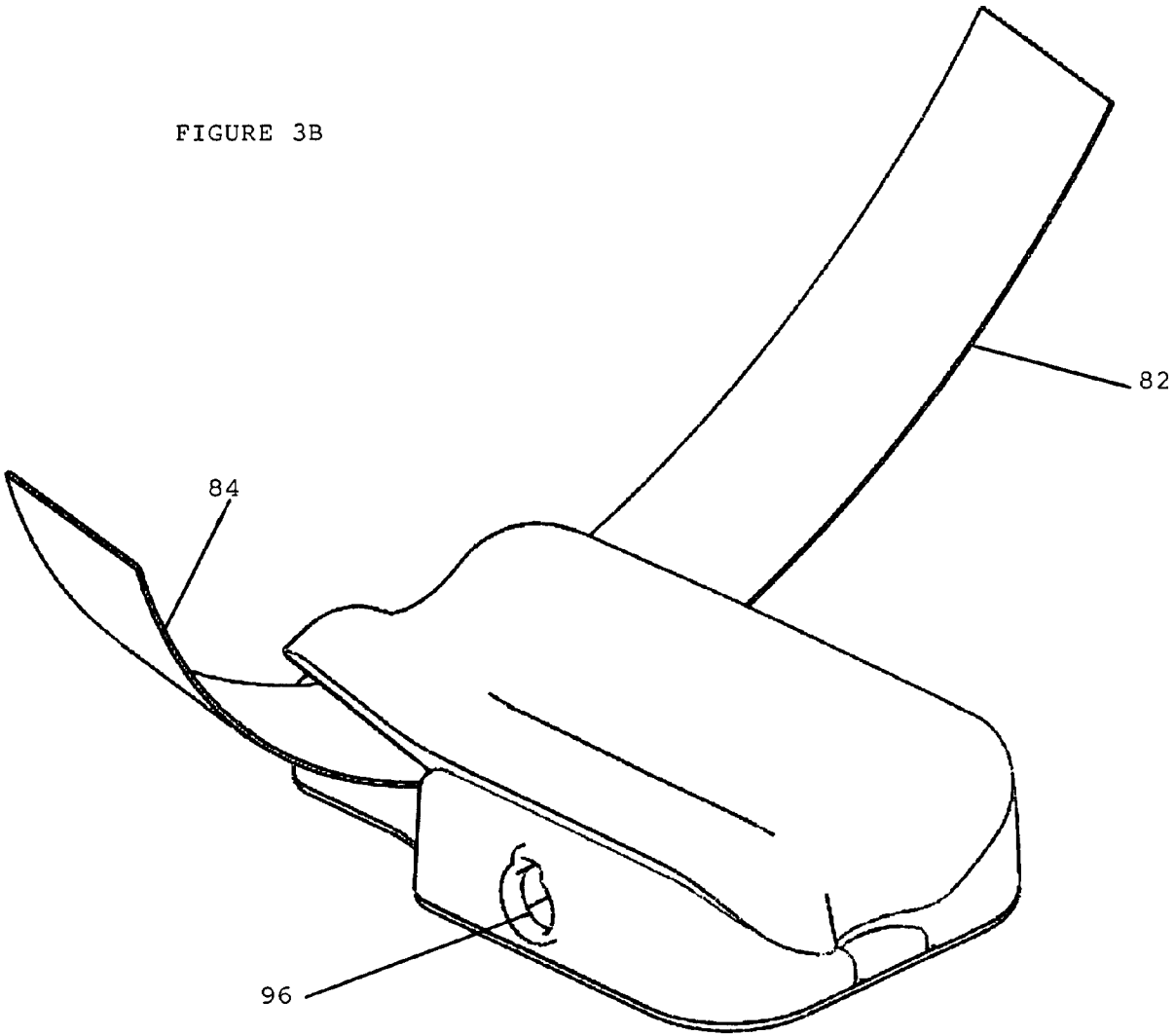
FIG. 3B is an Isometric View of the Knee Pad Insert and Knee Pad Straps.
Figure 4:
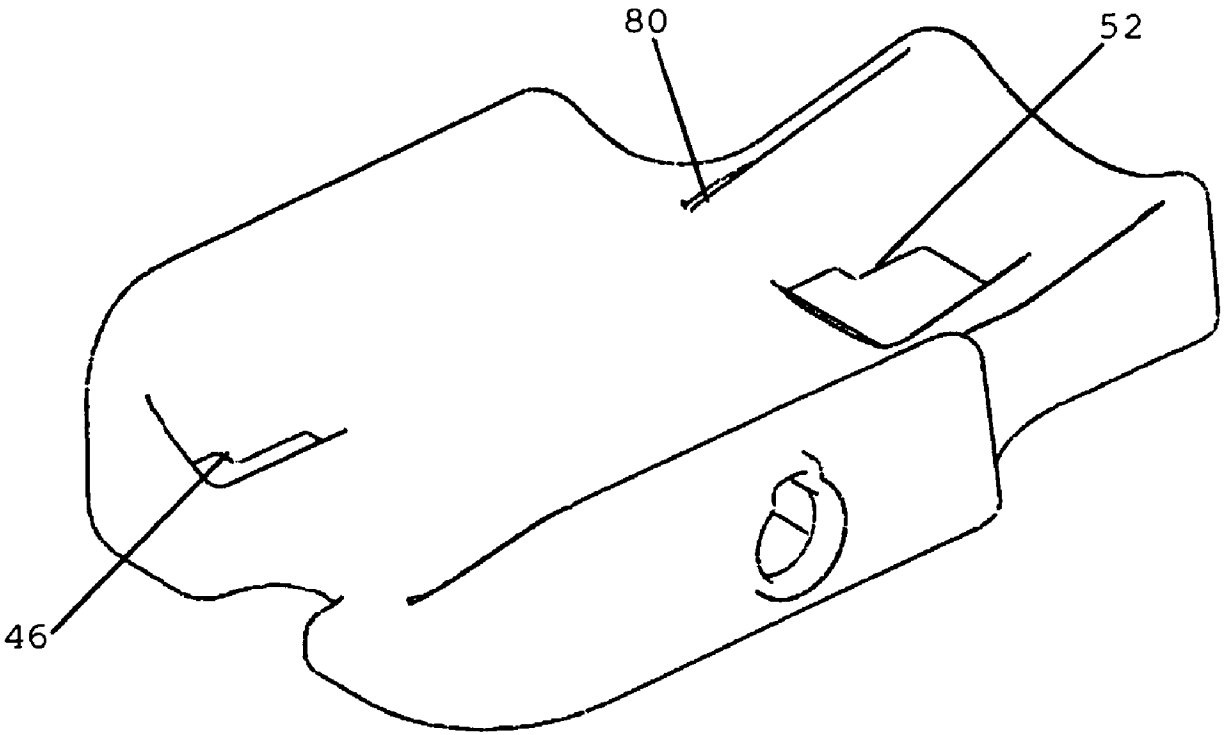
FIG. 4 is an Isometric View of the Knee Pad Insert.

As can be seen in FIG. 3, knee pad insert 72 may be rotated such that the first and second key slots, 94 and 96, are positioned to encounter the first and second keys, 98 and 100, respectively. Initially, the first key 98 is inserted into the first key slot 94. Then, second key 100 is inserted into second key slot 96. Once the keys and slots are joined, the knee pad insert 72 is in its unlocked position within the knee pad insert adjoining means 74, which is shown in FIG. 3A. Thereafter, knee pad insert 72 may be rotated to the position shown in FIG. 2, which is the locked position.

Figure 5:
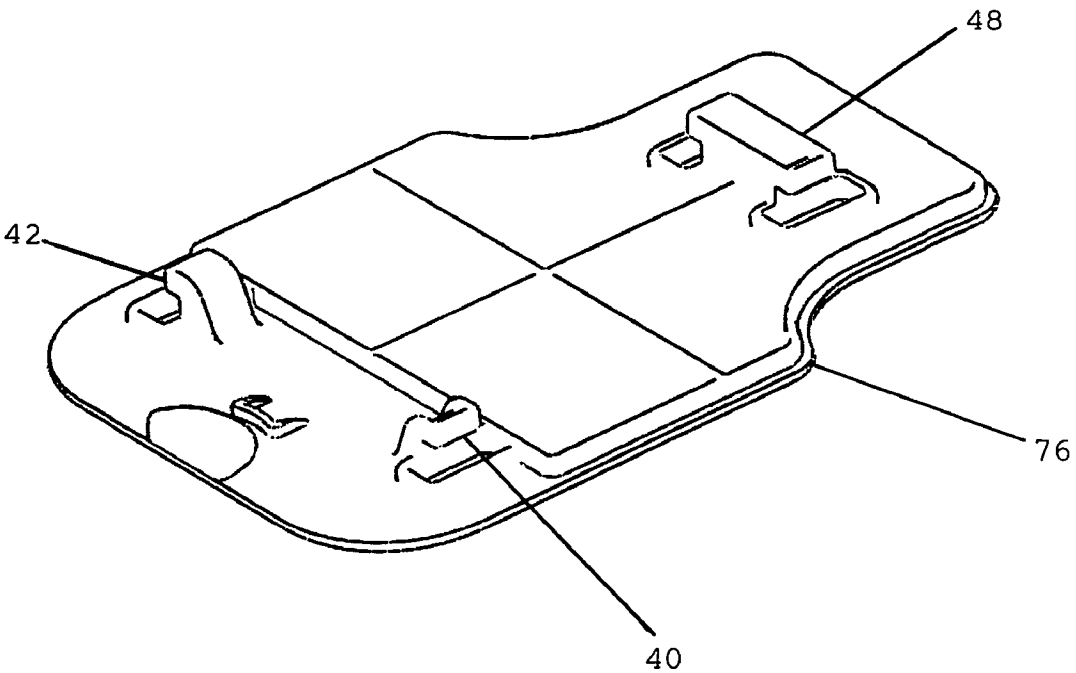
FIG. 5 is an Isometric View of the Skid Plate Insert.

In the preferred embodiment of the invention, skid plate insert 76 is attached to knee pad insert 72. As can be seen in FIG. 5, skid plate insert 76 has a first frontal bracket 40 and a second frontal bracket 42. Correspondingly, as can be seen in FIG. 4, the knee pad insert 72 has a first frontal tab 44 and a second frontal tab 46. Additionally, skid plate insert 76 has a rear double bracket 48, and knee pad insert 72 has a first rear tab 50 and a second rear tab 52.

Figure 6:
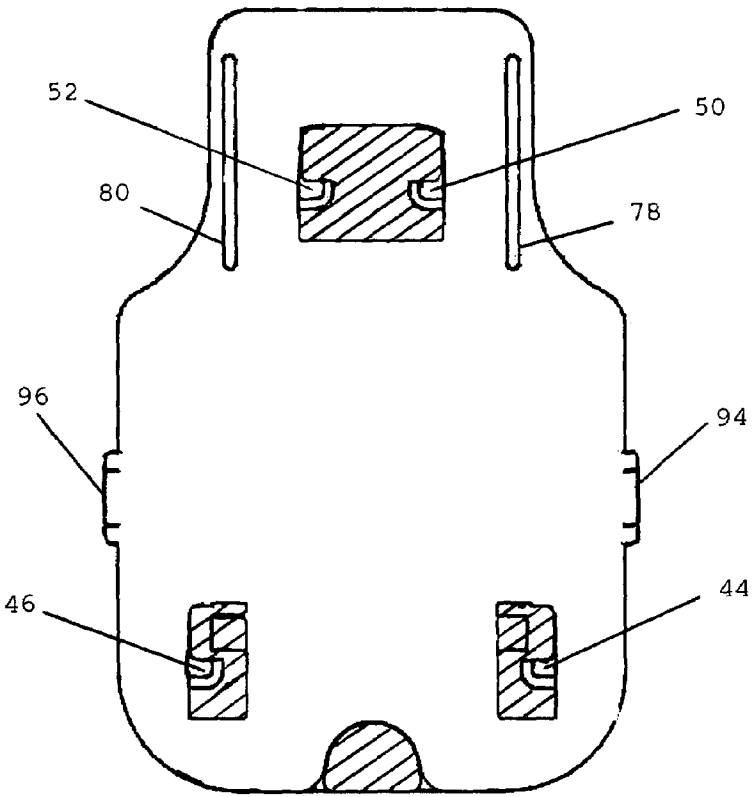
FIG. 6 is a Top View of the Skid Plate Insert Adjoined to the Knee Pad Insert.

Skid plate insert 76 is attached to knee pad insert 72 by first holding the two pieces in a vertical plane with a slight offset, placing skid plate insert 76 slightly behind knee pad insert 72. Second, the pieces are brought into contact with the slight offset, so that first frontal bracket 40 and second frontal bracket 42 are positioned before first frontal tab 44 and second frontal tab 46, respectively; and, first rear tab 50 and second rear tab 52 are positioned behind the extended portions of rear double bracket 48. Then, knee pad insert 72 is pushed forward so that first frontal tab 44 and second frontal tab 46 pass under first frontal bracket 40 and second frontal bracket 42, respectively; and, first rear tab 50 and second rear tab 52 pass under the rear double bracket 48 at their respective sides. This configuration is shown in FIG. 6.

In the preferred embodiment of the invention, cushioning pads are incorporated onto the device. More specifically, as seen in FIG. 1, cushioning knee pad 56 is adjoined to knee pad insert 72; cushioning shin pad 36 is adjoined to ankle frame 14; and cushioning seat pad 20 is adjoined to seat 16. Preferably, industrial strength epoxy is used to attach the cushioning pads to the device.

Alternative Embodiments

While the above description contains many specificities, these should not be construed as limitations on the scope of the invention, but rather as an exemplification of one preferred embodiment thereof. Many variations are possible and some are as follows.

First, the materials used in the modular lower body support device can be wood, metal, plastic, composite, or other materials commonly used in the knee pad, body armor, or similar industries. Different materials allow differing strengths and weaknesses which would be used to match consumer preferences, needs, and budget restraints.

Second, seating means 26 may be attached to the framing means 24 in many ways common in the prior art. Such ways of attachment include, but are not limited to, hinges, caps, clips, clamps, straps, screws, or latches.

Figure 7:
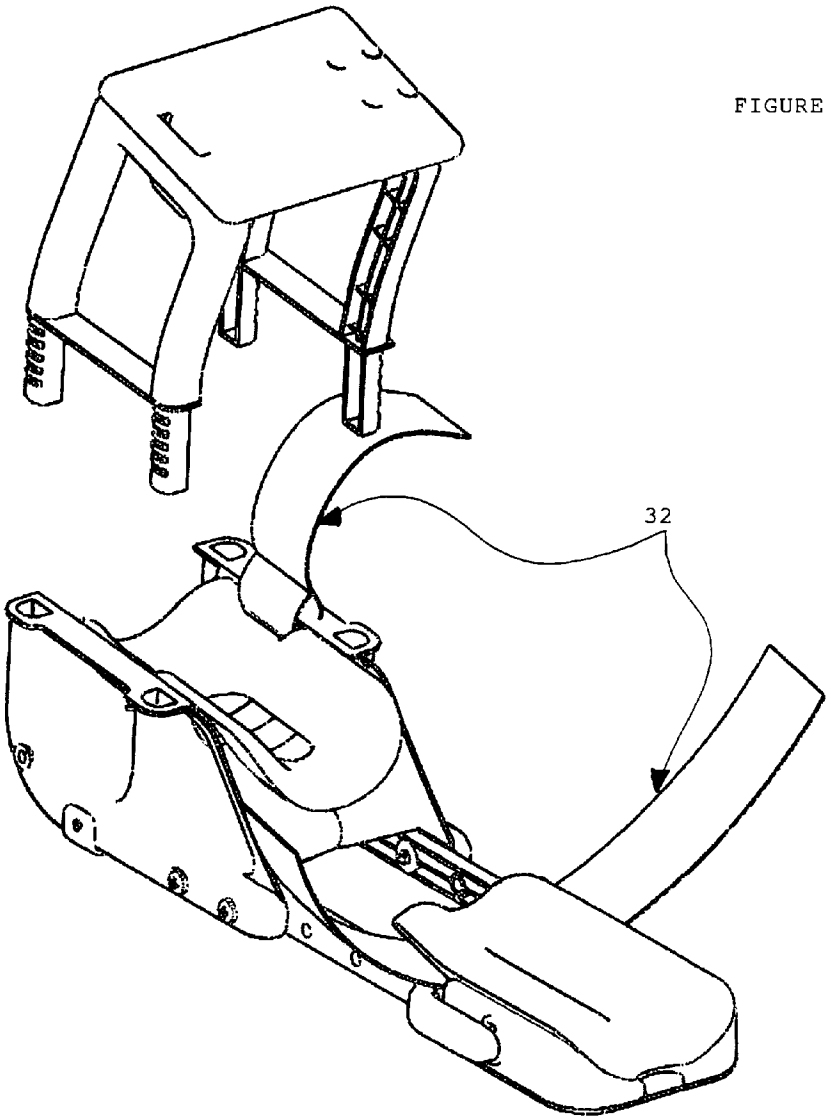
FIG. 7 is an Isometric View of an Alternative Embodiment with Seating Means Removed.

Indeed, seating means 26 could be detached or otherwise removed from the device. Such alternative embodiment is shown in FIG. 7.

Third, knee pad insert adjoining means 74 could employ numerous mounting methods common in the prior art. Such mounting methods include, but are limited to, straps, clamps, screws, latches, buttons, hook and loop fasteners, or bolts.

Fourth, many different ways exist in the prior art to attach cushioning pads to devices. Although industrial strength epoxy is the preferred manner of attachment, different processes common in the prior art may be used, including, but not limited to, hook and loop fasteners, glues, rivets, buttons, stitches, or snap-on connectors.

Fifth, instead of using threaded holes 102, threaded fasteners 104, and a securing fastener 106 for frame lengthening means 66, numerous fastening means commonly used could be adopted for application herein. For instance, without limitation, a plurality of hook and loop fasteners could be implemented, a series of holes and laces could be used, or tightening clamps could be mounted on the device.

Sixth, instead of using slots and straps, the knee fastening means 28 and ankle fastening means 30 could use numerous other fastening means commonly found in the prior art. For example, without limitation, the device could easily adopt a hook and lace system, a hole and lace system, or a clamping system.

Seventh, a single strap and slot combination could be used for the leg fastening means 32 instead of implementing both the knee fastening means 28 and ankle fastening means 30. Moreover, a single pairing of other fastening devices commonly found in the prior art could be used for the leg fastening means 32.

Eighth, a second strap could be implemented for ankle fastening means 30. That is, instead of putting first ankle frame strap 90 through second ankle frame slot 88, a second strap could be placed through second ankle frame slot 88, folded over, and stitched, leaving an extra length which would be tied, fastened, or otherwise linked to first ankle frame strap 90.

Figure 8:
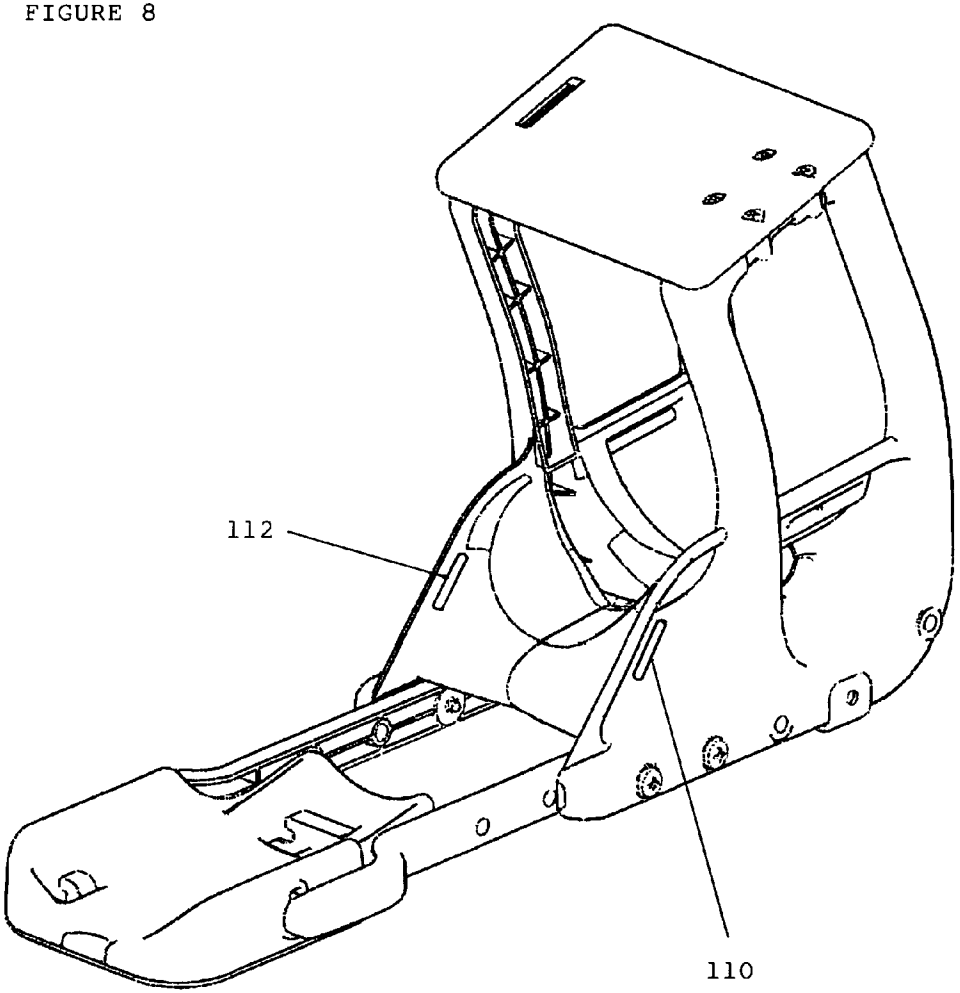
FIG. 8 is an Isometric View of the Modular Lower Body Support Device illustrating the Third and Fourth Ankle Frame Slots.

Ninth, moreover, at least two more slots, third ankle frame slot 110 and fourth ankle frame slot 112, could be implemented in ankle frame 14. See FIG. 8. In such an alternative embodiment, another strap, or more, would be used to further secure the leg of the user to the device.

The embodiments above-discussed are to be considered illustrative and not restrictive. Many more embodiments may be configured using combinations of the embodiments above-discussed. Thus, the scope of the invention should be determined by the appended claims and their legal equivalents.

CONCLUSIONS, RAMIFICATIONS, AND SCOPE

The utility of modular lower body support device is apparent. In the preferred embodiment, the device provides an easily replaceable knee pad insert, together with a replaceable skid plate insert, which may be integrated into a suitably comfortable and sturdy lower body support frame.

Clearly, implementing the knee pad inserts ensures that the user will have knee pads which fit within the tolerances of the invention. Moreover, once a knee pad insert wears out, the user may simply replace the knee pad insert without having to replace the entire device.

Additionally, allowing the user to adjust the length of the device increases its utility. More users will be able to use the device comfortably by adjusting the relative length of the device.

The above-discussion is to be considered illustrative and not restrictive. Thus, the scope of the invention should be determined by the appended claims and their legal equivalents.

We claim:

1. A modular lower body support device comprising, in combination:

A. a framing means for supporting a user,

B. a seating means, connectable to the framing means, for providing a place on which the user may sit, C. a knee pad insert, D. a skid plate insert, removably attachable to said knee pad insert, E. a knee pad insert adjoining means, for adjoining a knee pad insert to the framing means, F. a leg fastening means, connected to said framing means, for securing the lower leg of the user to the device, and G. a frame lengthening means, for adjusting the overall length of the device, whereby a user positions the leg of the user onto the framing means with the knee of the user upon the knee pad insert, which is connected to the framing means via the knee pad insert adjoining means, and secures the leg of the user to the device via the leg fastening means.

2. The device of claim 1, wherein said framing means comprises:

A. a knee frame,

B. a bend frame, and

C. an ankle frame, whereby the knee of the user fits within the region defined by the knee frame, the shin of the user fits within the region defined by the bend frame, and the ankle of the user fits within the region defined by the ankle frame.

3. The device of claim 1, wherein said knee pad insert adjoining means comprises:

A. a first key slot,

B. a second key slot,

C. a first key, and

D. a second key, whereby the knee pad insert may be removed or attached to said framing means via the first and second keys and key slots, respectively.

4. The device of claim 1, wherein said leg fastening means comprises:

A. a knee fastening means, connected to said framing means, for securing the lower leg of the user to the device, and B. an ankle fastening means, connected to said framing means, for securing the ankle of the user to the device.

5. The device of claim 4, wherein said knee fastening means comprises:

A. a first knee pad insert slot,

B. a second knee pad insert slot,

C. a first knee pad strap, and

D. a second knee pad strap.

6. The device of claim 4, wherein said ankle fastening means comprises:

A. a first ankle frame slot,

B. a second ankle frame slot, and

C. a first ankle frame strap.

7. The device of claim 1, wherein said frame lengthening means comprises:

A. a first bend frame side with a plurality of threaded holes for receiving threaded fasteners, B. a second bend frame side with a plurality of threaded holes for receiving threaded fasteners, C. a first ankle frame side with a plurality of threaded holes for receiving threaded fasteners, and D. a second ankle frame side with a plurality of threaded holes for receiving threaded fasteners, whereby the overall length of the device may be adjusted by aligning the threaded holes of the first bend frame side to the threaded holes of the first ankle frame side, and aligning the threaded holes of the second bend frame side to the threaded holes of the second ankle frame side, and thereafter threading and tightening threaded fasteners through the aligned holes on the respective sides.

8. The device of claim 1, wherein:

A. said framing means comprises:

i. a knee frame, ii. a bend frame, and iii. an ankle frame,

B. said knee pad insert adjoining means comprises:

i. a first key slot, ii. a second key slot, iii. a first key, and iv. a second key, C. said leg fastening means comprises:

i. a knee fastening means, connected to said framing means, for securing the lower leg of the user to the device, and ii. an ankle fastening means, connected to said framing means, for securing the ankle of the user to the device, D. said frame lengthening means comprises:

i. a first bend frame side with a plurality of threaded holes for receiving threaded fasteners, ii. a second bend frame side with a plurality of threaded holes for receiving threaded fasteners, iii. a first ankle frame side with a plurality of threaded holes for receiving threaded fasteners, and iv. a second ankle frame side with a plurality of threaded holes for receiving threaded fasteners, whereby the knee of the user fits within the region defined by the knee frame, the shin of the user fits within the region defined by the bend frame, and the ankle of the user fits within the region defined by the ankle frame; the knee pad insert may be removed or attached to said framing means via the first and second keys and key slots, respectively; the leg and the ankle of the user are securable to the device; and the overall length of the device may be adjusted by aligning the threaded holes of the first bend frame side to the threaded holes of the first ankle frame side, and aligning the threaded holes of the second bend frame side to the threaded holes of the second ankle frame side, and thereafter threading and tightening threaded fasteners through the aligned holes on the respective sides.

9. The device of claim 1, wherein:

A. said framing means comprises:
- i. a knee frame,
- ii. a bend frame, and
- iii. an ankle frame, B. said knee pad insert adjoining means comprises:
- i. a first key slot,
- ii. a second key slot,
- iii. a first key, and
- iv. a second key, C. said leg fastening means comprises:
- i. a knee fastening means, connected to said framing means, for securing the lower leg of the user to the device, comprising:
  - a. a first knee pad insert slot,
  - b. a second knee pad insert slot,
  - c. a first knee pad strap, and
  - d. a second knee pad strap,
- ii. an ankle fastening means, connected to said framing means, for securing the ankle of the user to the device, comprising:
  - a. a first ankle frame slot,
  - b. a second ankle frame slot, and
  - c. a first ankle frame strap, D. said frame lengthening means comprises:
- i. a first bend frame side with a plurality of threaded holes for receiving threaded fasteners,
- ii. a second bend frame side with a plurality of threaded holes for receiving threaded fasteners,
- iii. a first ankle frame side with a plurality of threaded holes for receiving threaded fasteners, and
- iv. a second ankle frame side with a plurality of threaded holes for receiving threaded fasteners, whereby the knee of the user fits within the region defined by the knee frame, the shin of the user fits within the region defined by the bend frame, and the ankle of the user fits within the region defined by the ankle frame; the knee pad insert may be removed or attached to said framing means via the first and second keys and key slots, respectively; the leg and the ankle of the user are securable to the device; and the overall length of the device may be adjusted by aligning the threaded holes of the first bend frame side to the threaded holes of the first ankle frame side, and aligning the threaded holes of the second bend frame side to the threaded holes of the second ankle frame side, and thereafter threading and tightening threaded fasteners through the aligned holes on the respective sides.

10. A modular lower body support device comprising, in combination:

A. a framing means for supporting a user, comprising:
- i. a knee frame,
- ii. a bend frame, and
- iii. an ankle frame, B. a seating means, connectable to the framing means, for providing a place on which the user may sit, C. a knee pad insert, D. a knee pad insert adjoining means, for adjoining a knee pad insert to the framing means, comprising:
- i. a first key slot,
- ii. a second key slot,
- iii. a first key, and
- iv. a second key, E. a knee fastening means, connected to said knee frame, for securing the lower leg of the user to the device, comprising:
- i. a first knee pad insert slot,
- ii. a second knee pad insert slot,
- iii. a first knee pad strap, and
- iv. a second knee pad strap, F. an ankle fastening means, connected to said ankle frame, for securing the ankle of the user to the device, comprising:
- i. a first ankle frame slot,
- ii. a second ankle frame slot, and
- iii. a first ankle frame strap, G. a frame lengthening means, for adjusting the overall length of the device, comprising:
- i. a first bend frame side with a plurality of threaded holes for receiving threaded fasteners,
- ii. a second bend frame side with a plurality of threaded holes for receiving threaded fasteners,
- iii. a first ankle frame side with a plurality of threaded holes for receiving threaded fasteners, and
- iv. a second ankle frame side with a plurality of threaded holes for receiving threaded fasteners, whereby the knee of the user fits within the region defined by the knee frame, the shin of the user fits within the region defined by the bend frame, and the ankle of the user fits within the region defined by the ankle frame; the knee pad insert may be removed or attached to said framing means via the first and second keys and key slots, respectively; the leg and the ankle of the user are securable to the device; and the overall length of the device may be adjusted by aligning the threaded holes of the first bend frame side to the threaded holes of the first ankle frame side, and aligning the threaded holes of the second bend frame side to the threaded holes of the second ankle frame side, and thereafter threading and tightening threaded fasteners through the aligned holes on the respective sides.

11. A method for attaching a leg of a person to a modular lower body support device, comprising the steps of:

A. providing a framing means for supporting a user

B. providing a seating means, connectable to the framing means, for allowing a place on which the user may sit, C. providing a knee pad insert, for receiving the knee of the user, D. providing a knee pad insert adjoining means, for adjoining a knee pad insert to the framing means, E. providing a leg fastening means, connected to said framing means, for securing the lower leg of the user to the device, and F. providing a frame lengthening means, for adjusting the overall length of the device, whereby a user positions the leg of the user onto the framing means with the knee of the user upon the knee pad insert, which is connected to the framing means via the knee pad insert adjoining means, and secures the leg of the user to the device via the leg fastening means.

12. The method of claim 11, wherein said framing means comprises:

A. a knee frame,

B. a bend frame, and

C. an ankle frame, whereby the knee of the user fits within the region defined by the knee frame, the shin of the user fits within the region defined by the bend frame, and the ankle of the user fits within the region defined by the ankle frame.

13. The method of claim 11, wherein said knee pad insert adjoining means comprises:

A. a first key slot,

B. a second key slot,

C. a first key, and

D. a second key, whereby the knee pad insert may be removed or attached to said framing means via the first and second keys and key slots, respectively.

14. The method of claim 11, wherein said leg fastening means comprises:

A. a knee fastening means, connected to said framing means, for securing the lower leg of the user to the device, and B. an ankle fastening means, connected to said framing means, for securing the ankle of the user to the device.

15. The method of claim 14, wherein said knee fastening means comprises:

A. a first knee pad insert slot,

B. a second knee pad insert slot,

C. a first knee pad strap, and

D. a second knee pad strap.

16. The method of claim 14, wherein said ankle fastening means comprises:

A. a first ankle frame slot,

B. a second ankle frame slot, and

C. a first ankle frame strap.

17. The method of claim 11, wherein said frame lengthening means comprises:

A. a first bend frame side with a plurality of threaded holes for receiving threaded fasteners, B. a second bend frame side with a plurality of threaded holes for receiving threaded fasteners, C. a first ankle frame side with a plurality of threaded holes for receiving threaded fasteners, and D. a second ankle frame side with a plurality of threaded holes for receiving threaded fasteners, whereby the overall length of the device may be adjusted by aligning the threaded holes of the first bend frame side to the threaded holes of the first ankle frame side, and aligning the threaded holes of the second bend frame side to the threaded holes of the second ankle frame side, and thereafter threading and tightening threaded fasteners through the aligned holes on the respective sides.

18. The method of claim 11, wherein:

A. said framing means comprises:

i. a knee frame, ii. a bend frame, and iii. an ankle frame,

B. said knee pad insert adjoining means comprises:

i. a first key slot, ii. a second key slot, iii. a first key, and iv. a second key, C. said leg fastening means comprises:

i. a knee fastening means, connected to said framing means, for securing the lower leg of the user to the device, and ii. an ankle fastening means, connected to said framing means, for securing the ankle of the user to the device, D. said frame lengthening means comprises:

i. a first bend frame side with a plurality of threaded holes for receiving threaded fasteners, ii. a second bend frame side with a plurality of threaded holes for receiving threaded fasteners, iii. a first ankle frame side with a plurality of threaded holes for receiving threaded fasteners, and iv. a second ankle frame side with a plurality of threaded holes for receiving threaded fasteners, whereby the knee of the user fits within the region defined by the knee frame, the shin of the user fits within the region defined by the bend frame, and the ankle of the user fits within the region defined by the ankle frame; the knee pad insert may be removed or attached to said framing means via the first and second keys and key slots, respectively; and the overall length of the device may be adjusted by aligning the threaded holes of the first bend frame side to the threaded holes of the first ankle frame side, and aligning the threaded holes of the second bend frame side to the threaded holes of the second ankle frame side, and thereafter threading and tightening threaded fasteners through the aligned holes on the respective sides.

19. The method of claim 11, wherein:

A. said framing means comprises:

i. a knee frame, ii. a bend frame, and iii. an ankle frame,

B. said knee pad insert adjoining means comprises:

i. a first key slot, ii. a second key slot, iii. a first key, and iv. a second key, C. said leg fastening means comprises:

i. a knee fastening means, connected to said framing means, for securing the lower leg of the user to the device, comprising:

a. a first knee pad insert slot, b. a second knee pad insert slot, c. a first knee pad strap, and d. a second knee pad strap, ii. an ankle fastening means, connected to said framing means, for securing the ankle of the user to the device, comprising:

a. a first ankle frame slot, b. a second ankle frame slot, and c. a first ankle frame strap, D. said frame lengthening means comprises:

i. a first bend frame side with a plurality of threaded holes for receiving threaded fasteners, ii. a second bend frame side with a plurality of threaded holes for receiving threaded fasteners, iii. a first ankle frame side with a plurality of threaded holes for receiving threaded fasteners, and iv. a second ankle frame side with a plurality of threaded holes for receiving threaded fasteners, whereby the knee of the user fits within the region defined by the knee frame, the shin of the user fits within the region defined by the bend frame, and the ankle of the user fits within the region defined by the ankle frame; the knee pad insert may be removed or attached to said framing means via the first and second keys and key slots, respectively; and the overall length of the device may be adjusted by aligning the threaded holes of the first bend frame side to the threaded holes of the first ankle frame side, and aligning the threaded holes of the second bend frame side to the threaded holes of the second ankle frame side, and thereafter threading and tightening threaded fasteners through the aligned holes on the respective sides.

* * * * *